US006538370B1

(12) United States Patent
Amano et al.

(10) Patent No.: US 6,538,370 B1
(45) Date of Patent: Mar. 25, 2003

(54) CATHODE-RAY TUBE AND ELECTRON GUN HAVING REDUCED RADIATION

(75) Inventors: Yasunobu Amano, Tokyo (JP); Norifumi Kikuchi, Kanagawa (JP); Takashi Shirai, Kanagawa (JP); Motomu Tadama, Kanagawa (JP); Kazuo Sugimoto, Tokyo (JP); Mitsunori Endou, Tokyo (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/361,147

(22) Filed: Jul. 27, 1999

(51) Int. Cl.[7] ..... H01J 29/46

(52) U.S. Cl. ..... 313/447; 313/452; 313/441; 313/409; 315/382; 315/382.1; 315/15; 315/381

(58) Field of Search ..... 313/409–417, 313/441–460, 447 HC; 315/382, 382.1, 381, 15, 3

(56) References Cited

U.S. PATENT DOCUMENTS 4,855,638 A * 8/1989 Himmelbauer ..... 313/452

FOREIGN PATENT DOCUMENTS

JP 410241599 * 9/1998 ..... H01J/29/50

* cited by examiner

*Primary Examiner*—Nimeshkumar D. Patel
*Assistant Examiner*—Mariceli Santiago
(74) *Attorney, Agent, or Firm*—Rader, Fishman & Grauer PLLC; Ronald P. Kananen, Esq.

(57) ABSTRACT

A cathode-ray tube electron gun can alleviate unwanted radiation caused when cathodes and a first electron gun constitute an antenna by increasing the number of conduction leads of a first electrode of a cathode-ray tube electron gun from one to a plurality of conduction leads.

12 Claims, 12 Drawing Sheets

CATHODE-RAY TUBE AND ELECTRON GUN HAVING REDUCED RADIATION

BACKGROUND OF THE INVENTION

1. Field of the Invention

The present invention relates to a cathode-ray tube electron gun in which unwanted radiation can be reduced and an electron gun having such an cathode-ray tube.

2. Description of the Related Art

Recently, a problem of an unwanted radiation from a cathode-ray tube, in particular, a display monitor driven at a high-frequency voltage, becomes highlighted.

To cope with the unwanted radiation in the display monitor, there is a mainstream that a shield cover is provided to cover the whole of the cathode-ray tube so that unwanted radio waves can be prevented from being radiated to the outside of the cathode-ray tube. Accordingly, there is no technology in which a generation source itself of radio waves generated from a cathode-ray tube is analyzed and a fundamental countermeasure is devised.

When the cathode-ray tube is protected with the large shield cover as described above, it is unavoidable that a manufacturing cost of the cathode-ray tube increases.

On the other hand, the assignee of the present application has analyzed the related-art electron gun, and has discovered an unwanted radiation generation source for an electron gun.

FIG. 1 of the accompanying drawings shows a structure of a typical electron gun for use with a color cathode-ray tube.

As shown in FIG. 1, this electron gun 12 comprises three cathodes $K_R$, $K_G$ and $K_B$ corresponding to red, green and blue arranged in an inline fashion. A first electrode ($G_1$) 1, a second electrode ($G_2$) 2, a third electrode ($G_3$) 3, a fourth electrode ($G_4$) 4, a fifth electrode ($G_5$) 5, a sixth electrode ($G_6$) 6 are sequentially arranged on the same axis so as to become common to the three cathodes $K_R$, $K_G$ and $K_B$. A shield cup 7 is provided at the final stage, and this electron gun is arranged as a so-called unibipotential system three-beam single electron gun. The first electrode 1 and the second electrode 2 are each formed of a plate-like material.

The first electrode 1 is supplied with about 0V from a first electrode lead (electrically-conducting lead) 9, the second electrode 2 and the fourth electrode 4 are supplied with about 200V to 800V from a second electrode lead (electrically-conducting lead) 10 and the third electrode 3 and the fifth electrode 5 are supplied with a focusing voltage of about 20% to 35% of an anode voltage (high voltage) from a focus lead (electrically-conducting lead). The first electrode lead 9, the second electrode lead 10 and the focusing lead 11 are connected to stem pins, respectively. The sixth electrode 6 and the shield cup 7 are supplied with an anode voltage of about 20 kV to 32 kV. The three cathodes $K_R$, $K_G$, $K_B$ are driven by a high-frequency voltage (i.e., a so-called video signal).

In this electron gun 1, electron beams $B_R$, $B_G$ and $B_B$ generated and controlled y the cathodes $K_R$, $K_G$, $K_B$ and the first electrode 1 and the second electrode 2 are adjusted in divergence angle by a front-stage electron lens or a front-stage focusing lens comprising the third electrode 3, the fourth electrode 4 and the fifth electrode 5 and then focused by a main electron lens (i.e., a main focusing lens) comprising the fifth electrode 5 and the sixth electrode 6.

FIG. 2 shows a color cathode-ray tube having such electron gun 12.

As shown in FIG. 2, in a color cathode-ray tube 13, the above-mentioned electron gun 12 is disposed within a neck portion 15 of a cathode-ray tube assembly (i.e., a so-called glass bulb) 14 in an opposing relation to a fluorescent screen 17. A color selection mechanism is closely opposed to the fluorescent screen 17, although not shown. Further, there are disposed a deflection yoke 16 outside the cathode-ray tube assembly 14 for deflecting the electron beams $B_R$, $B_G$, $B_B$ in the horizontal and vertical directions. In FIG. 2, reference numeral 18 denotes a video base plate disposed on the end portion of the neck portion 15. This color cathode-ray tube 13 is covered at its whole rear portion except the front surface of a panel portion 19 with a shield cover material 20 in order to protect it from the influence of unwanted radiation, a terrestrial magnetism or the like.

In general, the first electrode lead 9 and the second electrode lead 10 of the above-mentioned electron gun 12 are each a single electrode lead because it is intended to supply a voltage for electrically conducting the electron gun 12. In particular, in the case of the plate-like first electrode 1 and second electrode 2, the first electrode lead 9 and the second electrode lead 10 are each a single electrode lead.

FIG. 3 is a schematic diagram showing the first electrode 1 having the cathodes $K_R$, $K_G$, $K_B$ and one lead 9 as a model example. In FIG. 3, reference numerals 22 denote electron beam apertures defined in the first electrode 1 to pass electron beams. With this arrangement, when the cathodes $K_R$, $K_G$, $K_B$ are driven by a high-frequency voltage, the first electrode 1, which is spaced apart from the cathodes $K_R$, $K_G$, $K_B$ by a short distance of about 50 $\mu$m to 200 $\mu$m has a capacity between it and the cathodes $K_R$, $K_G$, $K_B$, so that the cathodes $K_R$, $K_G$, $K_B$, the first electrode 1 and the first electrode lead 9 constitute a high-efficiency antenna, thereby causing unwanted radiation.

That is, the assignee of the present application has discovered that, when the first electrode lead 9 is the single electrode lead, the cathodes ($K_R$, $K_G$, $K_B$) and the first electrode 1 constitute the high-efficiency antenna which serves as an unwanted radio wave generation source.

This is also considered in the second electrode 2.

FIG. 4 is a schematic diagram showing the first electrode 1 having the cathodes $K_R$, $K_G$, $K_B$ and one lead 9 and the second electrode 2 having one lead 10 as a model example. In FIG. 4, reference numerals 23 designate electron beam apertures defined in the second electrode 2 to pass electron beams.

Since the second electrode 2 is spaced apart from the first electrode 1 by a distance of about 0.1 mm to 0.3 mm, although a magnitude of capacity becomes small as compared with that of the first electrode 1, the second electrode has a capacity between it and the cathodes $K_R$, $K_G$, $K_B$ to form an antenna to cause unwanted radiation.

Unwanted radiation generated from the electron gun 12 where the first electrode 1 and the second electrode 2 have each single leads 9 and 10 as shown by the model example in FIG. 3 or 4 is represented as shown by a curve I in FIG. 15 which shows unwanted radiation level.

The graph of FIG. 15 shows unwanted radiation level measured by a detection antenna located at the position distant from the electron gun 12 by a distance of 1 m when the high-frequency voltage is applied to the cathodes $K_R$, $K_G$, $K_B$. In the graph of FIG. 15, the vertical axis represents a relative value of unwanted radiation level, and the horizontal axis represents the frequency of the high-frequency voltage applied to the cathodes.

Accordingly, in the color cathode-ray tube 13 having the electron gun 12 which is arranged as shown in FIGS. 3 and 4, the shield cover material 20 shown in FIG. 2 should have a considerably strong shielding effect.

The radio wave generation source itself of the electron gun according to the related art has been described so far.

SUMMARY OF THE INVENTION

In view of the results obtained when the above-mentioned radio wave generation source itself was analyzed, it is an object of the present invention to provide a cathode-ray tube electron gun in which unwanted radiation can be alleviated and a cathode-ray tube including such electron gun.

According to the present invention, there is provided a cathode-ray tube electron in which a first electrode includes a plurality of electrical conduction leads.

Since the first electrode includes a plurality of conduction leads, the first electrode can achieve a shield action for the cathode so that unwanted radiation caused by the antenna comprised of the cathode and the first electrode according to the related art can be alleviated.

The cathode-ray tube according to the present invention includes the above-mentioned electron gun, i.e. the electron gun in which the first electrode includes a plurality of electrical conduction leads.

According to the above-mentioned arrangement, unwanted radiation caused in the cathode-ray tube by the antenna comprised of the cathode and the first electrode can be alleviated unlike the related-art electron gun.

According to a cathode-ray tube electron gun of a first embodiment of the invention, a first electrode includes a plurality of electrical conduction leads.

According to a cathode-ray tube electron gun of a second embodiment of the invention, a first electrode includes a plurality of electrical conduction leads and the electrical conduction leads are spaced apart from each other by a distance long enough to produce a shield action for cathodes.

According to a cathode-ray tube electron gun of a third embodiment of the invention, a first electrode includes more than two electrical conduction leads and said respective electrical conduction leads are set in a positional relationship such that a line connecting two points at which at least one set of the opposing two electrical conduction leads exist overlaps with a cathode region or exists near the cathode region as seen from the electrode surface of the first electrode.

According to a cathode-ray tube electron gun of a fourth embodiment of the invention, a first electrode includes more than three electrical conduction leads and the respective electrical conduction leads are set in a position relationship such that a cathode exists in a polygon connecting respective points in which the respective electrical conduction leads exist or sides of the polygon overlap with the cathode region as seen from the electrode surface of the first electrode.

According to a cathode-ray tube of a fifth embodiment of the invention, a second electrode includes a plurality of electrical conduction leads.

According to a cathode-ray tube of a sixth embodiment of the invention, a second electrode includes a plurality of electrical conduction leads and the electrical conduction leads are spaced apart from each other by a distance long enough to produce a shield action for cathodes.

According to a cathode-ray tube of a seventh embodiment of the invention, a second first electrode includes more than two electrical conduction leads and the respective electrical conduction leads are set in a positional relationship such that a line connecting two points at which at least one set of the opposing two electrical conduction leads exist overlaps with a cathode region or exists near said cathode region as seen from the electrode surface of the first electrode.

According to a cathode-ray tube of an eighth embodiment of the invention, a second electrode includes more than three electrical conduction leads and the respective electrical conduction leads are set in a position relationship such that a cathode exists in a polygon connecting respective points in which the respective electrical conduction leads exist or sides of the polygon overlap with the cathode region as seen from the electrode surface of the second electrode.

According to a cathode-ray tube of a ninth embodiment of the invention, in the cathode-ray tube electron gun according to the first embodiment, the second electrode includes a plurality of electrical conduction leads.

According to a cathode-ray tube of a tenth embodiment of the invention, in the cathode-ray tube electron gun according to the first embodiment, the second electrode includes a plurality of electrical conduction leads and the electrical conduction leads are spaced apart from each other by a distance long enough to produce a shield action for cathodes.

According to a cathode-ray tube of an eleventh embodiment of the invention, in the cathode-ray tube electron gun according to the first embodiment, the second electrode includes more than two electrical conduction leads and the respective electrical conduction leads are set in a positional relationship such that a line connecting two points at which at least one set of the opposing two electrical conduction leads exist overlaps with a cathode region or exists near the cathode region as seen from the electrode surface of the first electrode.

According to a cathode-ray tube electron gun of a twelfth invention, in the cathode-ray tube electron gun according to the first embodiment, the second electrode includes more than three electrical conduction leads and said respective electrical conduction leads are set in a position relationship such that a cathode exists in a polygon connecting respective points in which the respective electrical conduction leads exist or sides of the polygon overlap with the cathode region as seen from the electrode surface of the second electrode.

According to a cathode-ray tube electron gun of a thirteenth embodiment of the invention, in the cathode-ray tube electron gun according to the second embodiment, the second electrode includes a plurality of electrical conduction leads.

According to a cathode-ray tube electron gun of a fourteenth embodiment of the invention, in the cathode-ray tube electron gun according to the second embodiment, the second electrode includes a plurality of electrical conduction leads and the electrical conduction leads are spaced apart from each other by a distance long enough to produce a shield action for cathodes.

According to a cathode-ray tube electron gun of a fifteenth embodiment of the invention, in the cathode-ray tube electron gun according to the second embodiment, the second first electrode includes more than two electrical conduction leads and said respective electrical conduction leads are set in a positional relationship such that a line connecting two points at which at least one set of the opposing two electrical conduction leads exist overlaps with a cathode region or exists near the cathode region as seen from the electrode surface of the second electrode.

According to a cathode-ray tube electron gun of a sixteenth embodiment of the invention, in the cathode-ray tube electron gun according to a third embodiment, the second electrode includes more than three electrical conduction leads and the respective electrical conduction leads are set in a position relationship such that a cathode exists in a polygon connecting respective points in which the respective electrical conduction leads exist or sides of the polygon overlap with the cathode region as seen from the electrode surface of the second electrode.

According to a cathode-ray tube electron gun of a seventeenth embodiment of the invention, in the cathode-ray tube electron gun according to the third embodiment, the second electrode includes a plurality of electrical conduction leads.

According to a cathode-ray tube electron gun of an eighteenth embodiment of the invention, in the cathode-ray tube electron gun according to the third embodiment, the second electrode includes a plurality of electrical conduction leads and the electrical conduction leads are spaced apart from each other by a distance long enough to produce a shield action for cathodes.

According to a cathode-ray tube electron gun of nineteenth embodiment of the invention, in the cathode-ray tube electron gun according to the third embodiment, the second electrode includes more than two electrical conduction leads and the respective electrical conduction leads are set in a positional relationship such that a line connecting two points at which at least one set of the opposing two electrical conduction leads exist overlaps with a cathode region or exists near the cathode region as seen from the electrode surface of the second electrode.

According to a cathode-ray tube electron gun of a twentieth embodiment of the invention, in the cathode-ray tube electron gun according to the third embodiment, the second electrode includes more than three electrical conduction leads and the respective electrical conduction leads are set in a position relationship such that a cathode exists in a polygon connecting respective points in which the respective electrical conduction leads exist or sides of the polygon overlap with the cathode region as seen from the electrode surface of the second electrode.

According to a cathode-ray tube electron gun of a twenty-first embodiment of the invention, in the cathode-ray tube electron gun according to the fourth embodiment, the second electrode includes a plurality of electrical conduction leads.

According to a cathode-ray tube electron gun of a twenty-second embodiment of the invention, in the cathode-ray tube electron gun according to the fourth embodiment, the second electrode includes a plurality of electrical conduction leads and the electrical conduction leads are spaced apart from each other by a distance long enough to produce a shield action for cathodes.

According to a cathode-ray tube electron gun of a twenty-third embodiment of the invention, in the cathode-ray tube electron gun according,to the fourth embodiment, the second first electrode includes more than two electrical conduction leads and the respective electrical conduction leads are set in a positional relationship such that a line connecting two points at which at least one set of the opposing two electrical conduction leads exist overlaps with a cathode region or exists near the cathode region as seen from the electrode surface of the second electrode.

According to a cathode-ray tube electron gun of a twenty-fourth embodiment of the invention, in the cathode-ray tube electron gun according to the fourth embodiment, the second electrode includes more than three electrical conduction leads and the respective electrical conduction leads are set in a position relationship such that a cathode exists in a polygon connecting respective points in which the respective electrical conduction leads exist or sides of the polygon overlap with the cathode region as seen from the electrode surface of the second electrode.

A cathode-ray tube according to a twenty-fifth embodiment of the invention includes an electron gun of the first embodiment.

A cathode-ray tube according to a twenty-sixth embodiment of the invention includes an electron gun of the fifth embodiment.

A cathode-ray tube according to a twenty-eighth invention includes an electron gun of the ninth embodiment.

DESCRIPTION OF THE PREFERRED EMBODIMENTS

Figure 5:
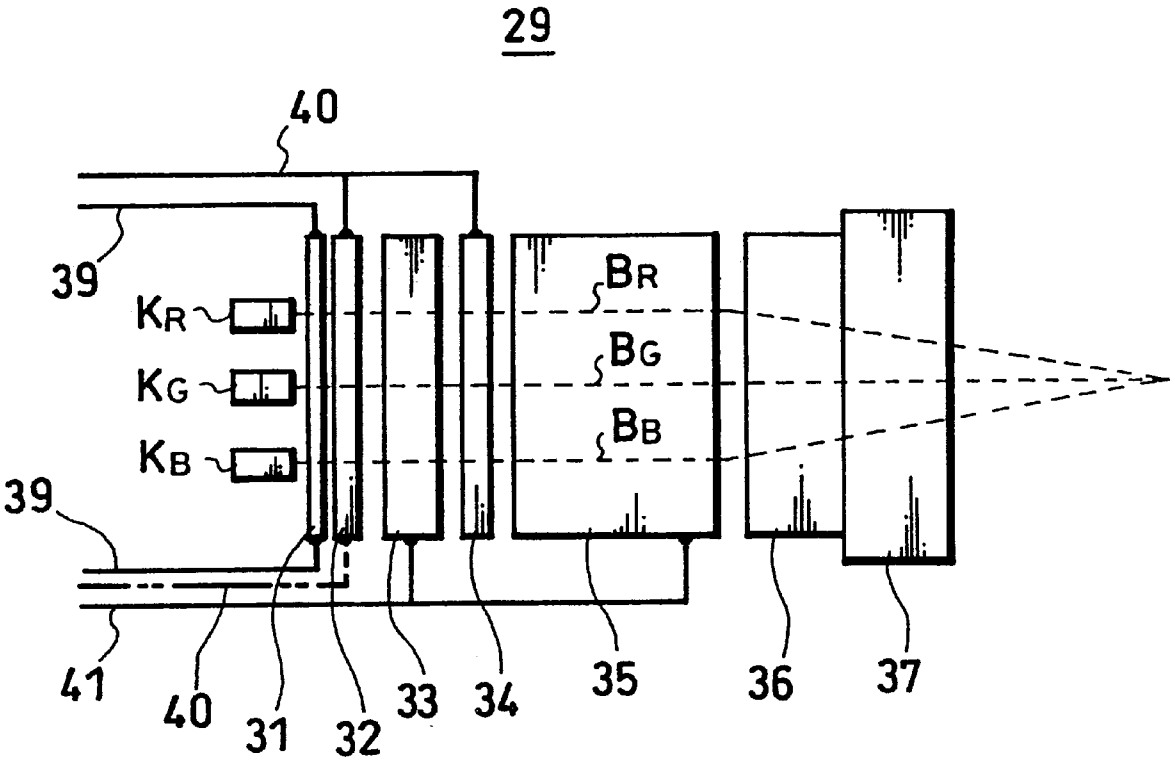
FIG. 5 is a schematic diagram showing a cathode-ray tube electron gun according to the present invention.
Figure 6:
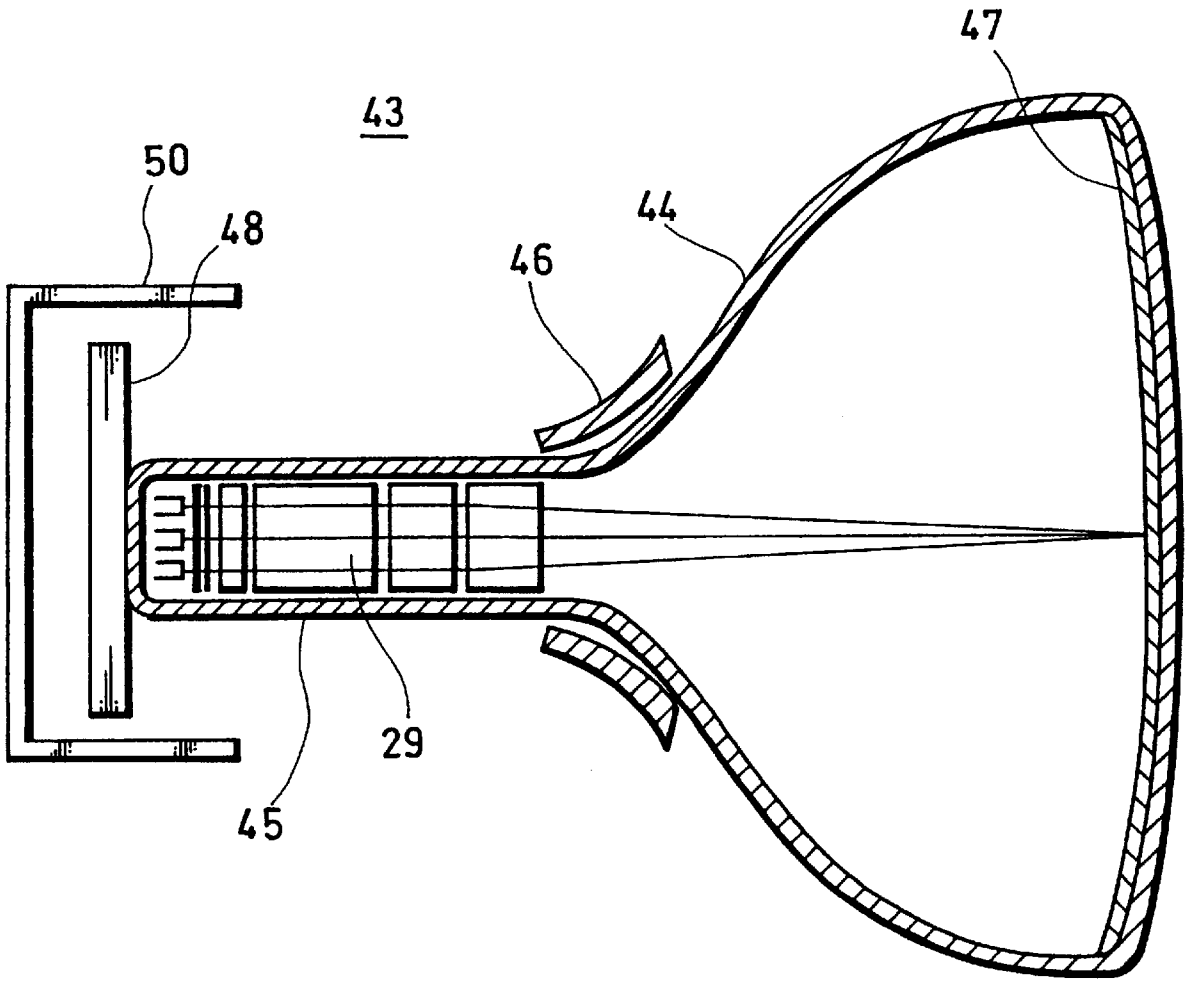
FIG. 6 is a schematic diagram showing a color cathode-ray tube according to the present invention.

FIG. 5 shows an example of a cathode-ray tube electron gun according to the present invention. FIG. 6 shows an example of a color cathode-ray tube including this electron gun according to the present invention.

Figure 1:
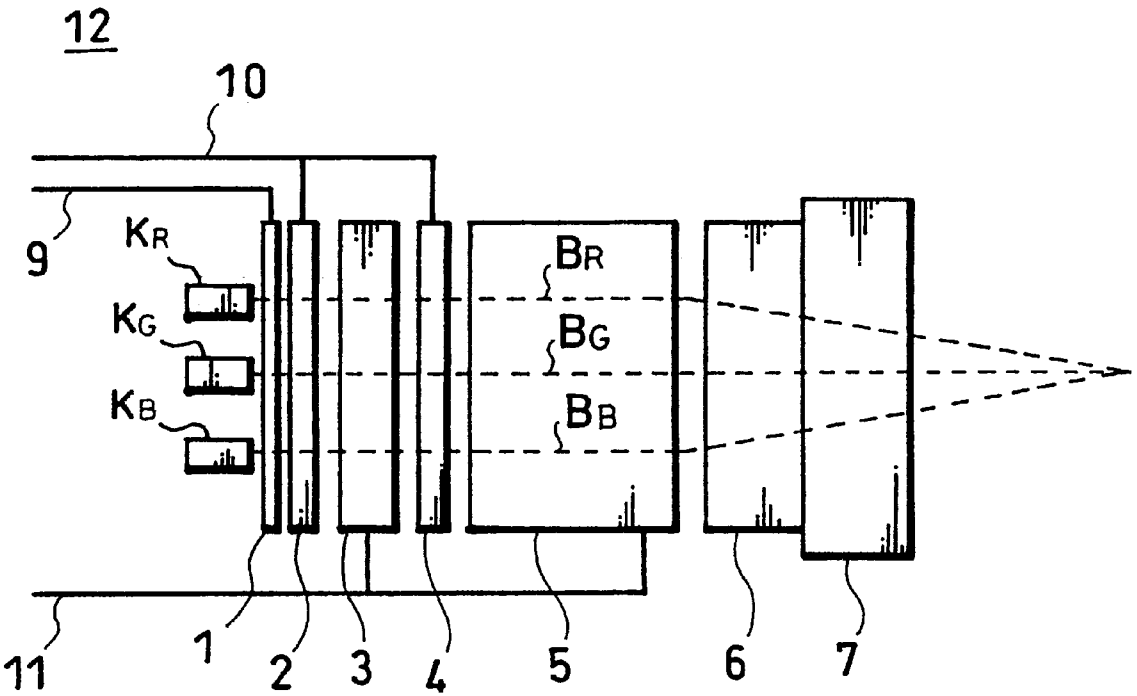
FIG. 1 PRIOR ART
FIG. 1 is a schematic diagram showing a cathode-ray tube electron gun according to the related art.
Figure 2:
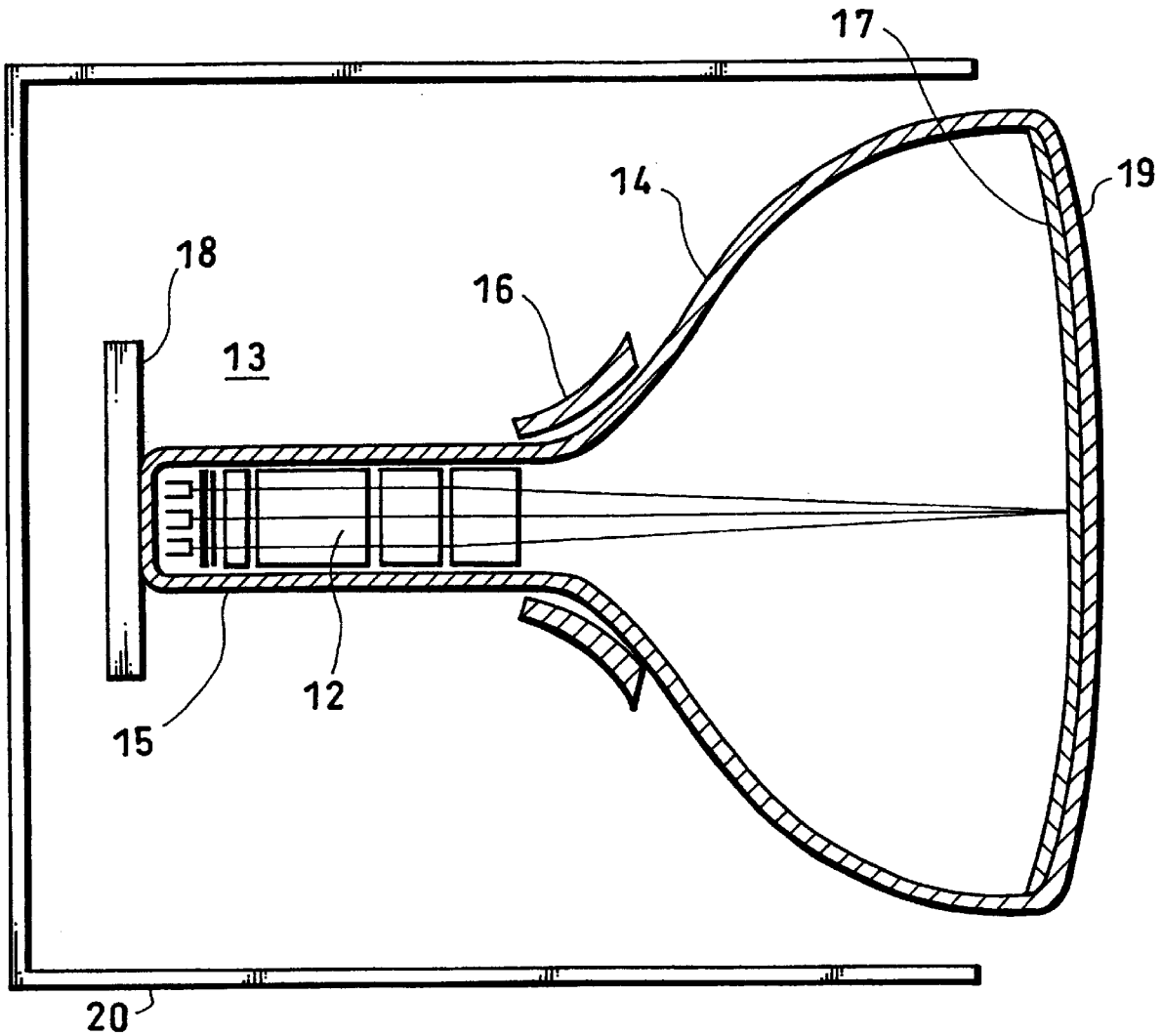
FIG. 2 PRIOR ART
FIG. 2 is a schematic diagram showing a color cathode-ray tube according to the related art.
Figure 3:
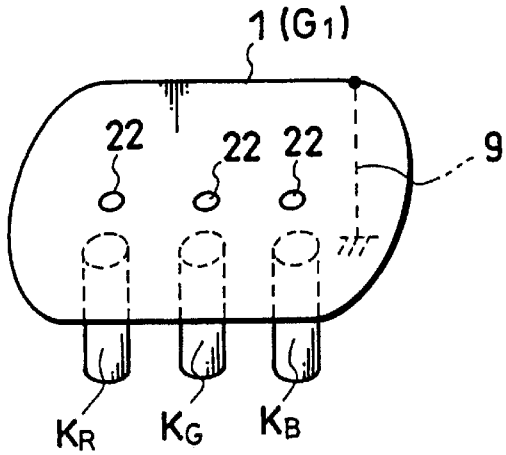
FIG. 3 PRIOR ART
FIG. 3 is a schematic diagram showing a first electrode of a related-art electron gun as a model example.
Figure 4:
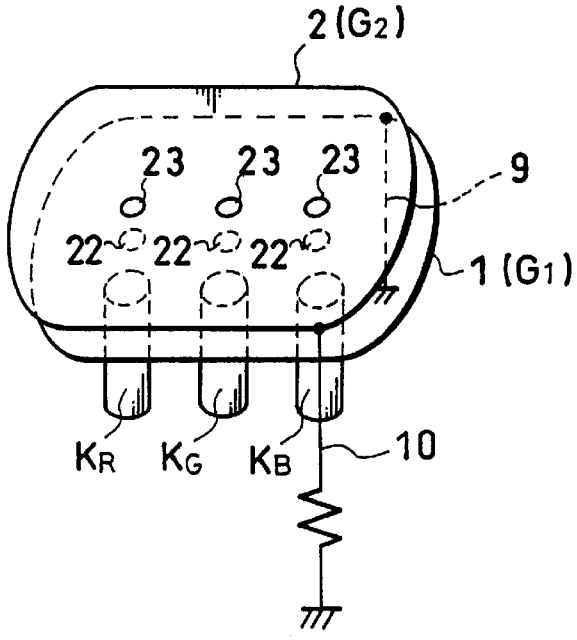
FIG. 4 PRIOR ART
FIG. 4 is a schematic diagram showing a first example and a second example of a related-art electron gun as model examples.

FIG. 5 shows the example in which the present invention is applied to a typical electron gun having an electrode structure similar to that of FIG. 1. That is, as shown in FIG. 5, this electron gun 29 comprises three cathodes $K_R$, $K_G$ and $K_B$ corresponding to red, green and blue arranged in an inline fashion. A first electrode ($G_1$) 31, a second electrode ($G_2$) 32, a third electron ($G_3$) 33, a fourth electrode ($G_4$) 34, a fifth electrode ($G_5$) 35, a sixth electrode ($G_6$) 36 are sequentially arranged on the same axis so as to become common to the three cathodes $K_R$, $K_G$ and $K_B$. A shield cup 37 is provided at the final stage, and this electron gun is arranged as a so-called unibipotential system three-beam single electron gun.

The first electrode 31 is supplied with about 0V from a first electrode lead (electrically-conducting lead) 39, the second electrode 32 and the fourth electrode 34 are supplied with about 200V to 800V from a second electrode lead (electrically-conducting lead) 40 and the third electrode 33 and the fifth electrode 35 are supplied with a focusing voltage of about 20 to 35% of an anode voltage (high voltage) from a focus lead (electrically-conducting lead) 41. The first electrode lead 39, the second electrode lead 40 and the focusing lead 41 are connected to stem pins, respectively. The sixth electrode 36 and the shield cup 37 are supplied with an anode voltage of about 20 kV to 32 kV. The three cathodes $K_R$, $K_G$, $K_B$ are driven by a high-frequency voltage such as a video signal.

In this electron gun 29, electron beams $B_R$, $B_G$ and $B_B$ generated and controlled by the cathodes $K_R$, $K_G$, $K_B$ and the first electrode 31 and the second electrode 32 are adjusted in divergence angle by a front-stage electron lens or the front-stage focusing lens comprising the third electrode 33, the fourth electrode 34 and the fifth electrode 35 and then focused by a main electron lens or main focusing lens comprising the fifth electrode 35 and the sixth electrode 36.

In a color cathode-ray tube 43 according to this embodiment shown in FIG. 6, the above-mentioned electron gun 29 shown in FIG. 1 is disposed within an neck portion 45 of a cathode-ray tube assembly (so-called glass bulb) 44 in an opposing relation to a fluorescent screen 47. A color selection mechanism is closely opposed to the fluorescent screen 47, although not shown. Further, there are disposed a deflection yoke 46 outside the cathode-ray tube assembly 44 for deflecting the electron beams $B_R$, $B_G$, $B_B$ in the horizontal and vertical directions. In FIG. 6, reference numeral 48 denotes a video base plate disposed on the end portion of the neck portion 45. This color cathode-ray tube 43 includes a simple shield cover material 50 so as to cover a part of the video base plate 48 and the neck portion 45 as will become clear later on.

In this embodiment, in particular, in the electron gun shown in FIG. 5, there are provided the conduction leads of the first electrode 1, i.e. the conduction leads of the first electrode lead 39 and the second electrode 2, i.e. a plurality of second electrode leads 40. Preferably, there are provided a plurality of only first electrode leads 39 or a plurality of first electrode leads 39 and second electrode leads 40, respectively. The first electrode lead 39 and the second electrode lead 40 are respectively led out from a plurality of places of the first electrode 31 and the second electrode 32.

FIGS. 7 to 13 show other specific embodiments of the present invention.

Figure 7:
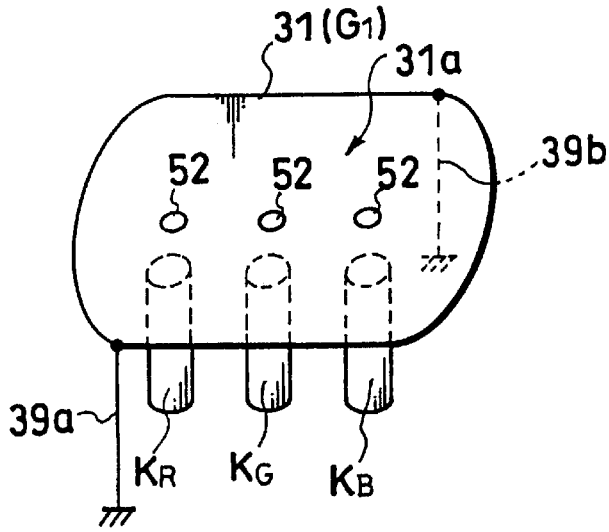
FIG. 7 is a schematic diagram showing the state in which a conduction lead connected to a first electrode is provided at two places across the cathode.

In the embodiment shown in FIG. 7 (an arrangement in which only the cathode and the first electrode are illustrated as model examples), two first electrode leads 39*a*, 39*b* are connected to two places of the plate-like first electrode 31 of the oblong circular shape, i.e. two places opposing across the cathodes $K_R$, $K_G$, $K_B$ of the inline arrangement as seen from its electrode surface 31*a*, in this embodiment, two places in the diagonal line direction. V (so-called ground voltage) is applied to the two first electrode leads 39*a*, 39*b*. In FIG. 7, reference numeral 52 denote electron beam apertures defined in the first electrode 31 to pass electron beams.

Figure 15:
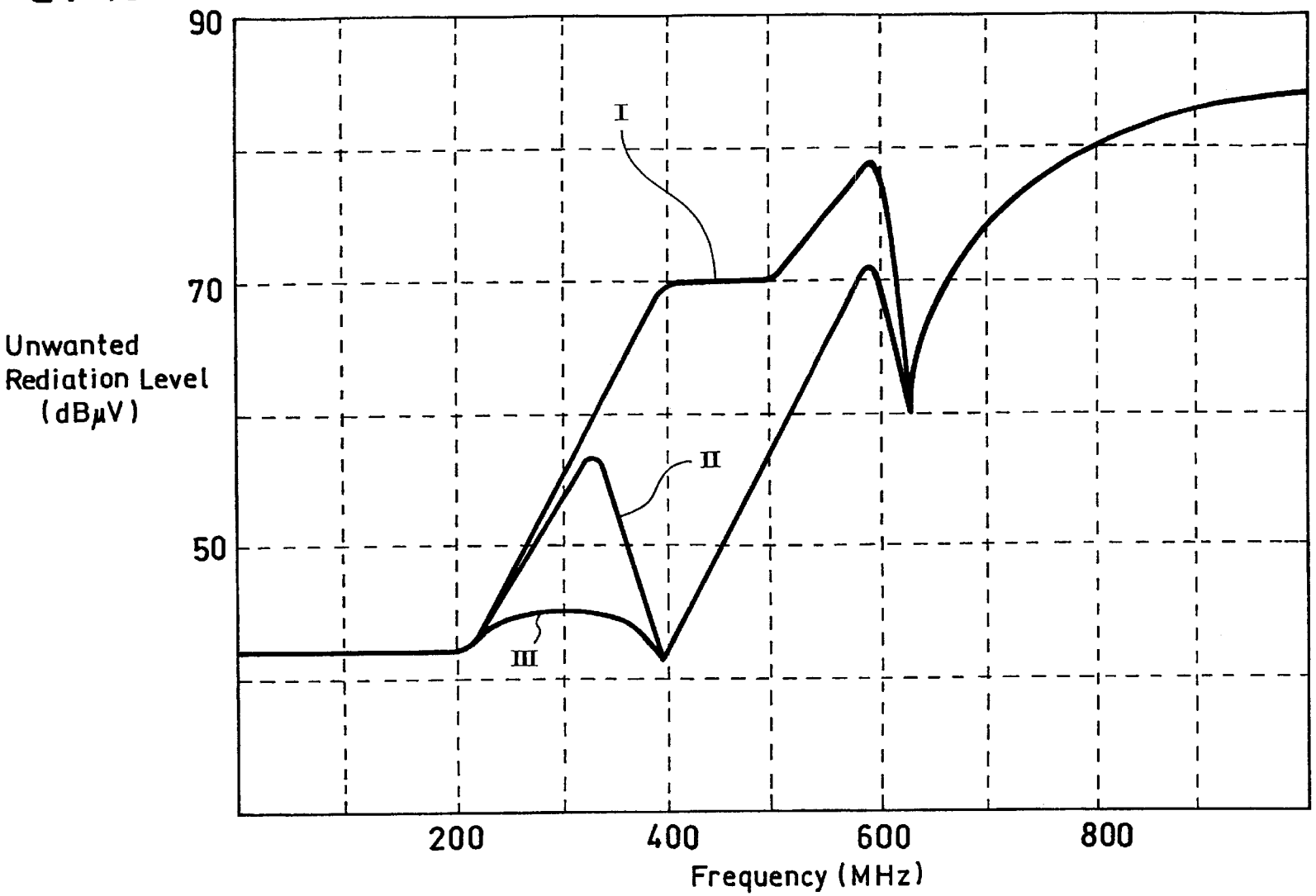
FIG. 15 is a graph showing measured results obtained when frequency versus unwanted radiation levels of a drive voltage supplied to the cathode of the related art and the present invention are compared with each other.

Since the two first electrode leads 39*a*, 39*b* are led out from the two places opposing the first electrode 31 across the cathodes $K_R$, $K_G$, $K_B$ as described above, the first electrode 31 has a so-called shield action against the cathodes $K_R$, $K_G$, $K_B$ so that unwanted radiation can be considerably improved as shown by a curve II in FIG. 15. Incidentally, the curve II represents the measured results obtained when there is used one conduction lead 40 of the second electrode 32.

Figure 8:
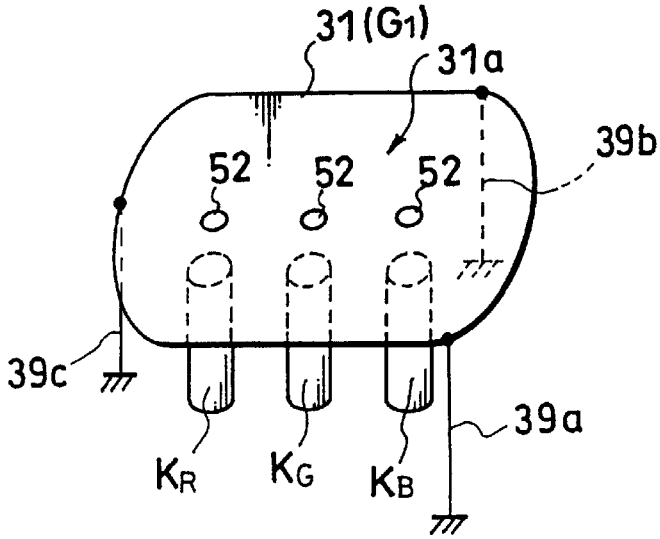
FIG. 8 is a schematic diagram showing the state in which a conduction lead connected to a first electrode is provided at three places surrounding the cathode.

In the embodiment shown in FIG. 8 (an arrangement in which only the first electrode and the cathode are illustrated as model examples), three first electrode leads 39*a*, 39*b*, 39*c* are led out from three places of the plate-like first electrode 31, i.e. three places surrounding the cathodes $K_R$, $K_G$, $K_B$ of the inline arrangement as seen from the electrode surface 31*a*, in this embodiment, three places corresponding to respective vertexes of an isosceles triangle. 0V (so-called ground voltage) is applied to the three first electrode leads 39*a*, 39*b*, 39*c*.

Figure 9:
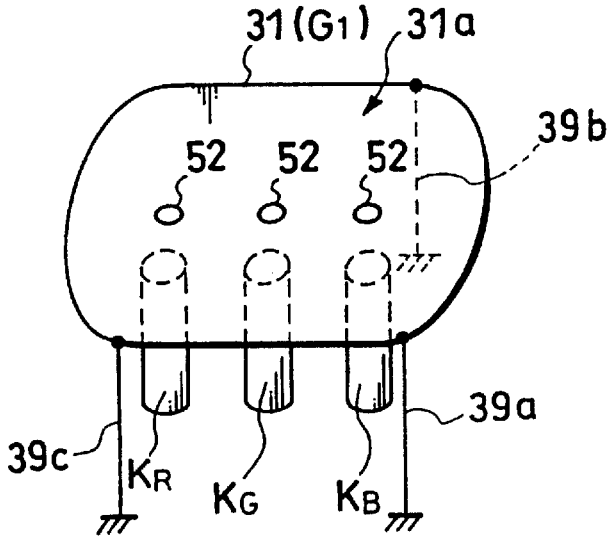
FIG. 9 is a schematic diagram showing the state in which a conduction lead connected to a first electrode is provided at three corners surrounding the cathode.

In the embodiment shown in FIG. 9 (an arrangement in which only the cathode and the first electrode are illustrated as model examples), three first electrodes 39*a*, 39*b*, 39*c* are led out from similar three places of the first electrode 31, in this embodiment, places corresponding to three corner portions so as to surround the cathodes $K_R$, $K_G$, $K_B$ of the inline arrangement as seen from the electrode surface 31*a*. 0V (so-called ground potential) is applied to the respective leads 39*a*, 39*b*, 39*c*.

In the embodiments shown in FIGS. 8 and 9, since there are provided the three first electrode leads 39, the shield action of the first electrode against the cathodes $K_R$, $K_G$, $K_B$ becomes strong so that a tendency similar to that of the curve II in FIG. 15 is established, thereby making it possible to improve the unwanted radiation considerably.

Figure 10:
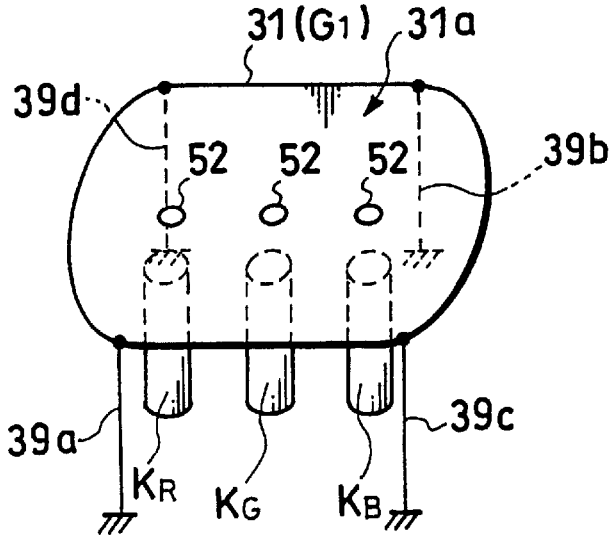
FIG. 10 is a schematic diagram showing the state in which a conduction lead connected to a first electrode is provided at four corners surrounding the cathode.

In the embodiment shown in FIG. 10 (an arrangement in which only the cathode and the first electrode are illustrated as model examples), four first electrode leads 39*a*, 39*b*, 39*c*, 39*d* are led out from four places of the plate-like first electrode 31, i.e. four places surrounding the cathodes $K_R$, $K_G$, $K_B$ of the inline arrangement as seen from its electrode surface 31*a*, in this embodiment, places corresponding to four corners.

According to the embodiment shown in FIG. 10, since the four first electrodes 39*a* to 39*d* are provided so as to surround the cathodes $K_R$, $K_G$, $K_B$, the shield action of the first electrode 31 against the cathodes $K_R$, $K_G$, $K_B$ becomes further strong so that a tendency similar to that of the curve II in FIG. 15 is established, thereby making it possible to improve unwanted radiation considerably.

Figure 11:
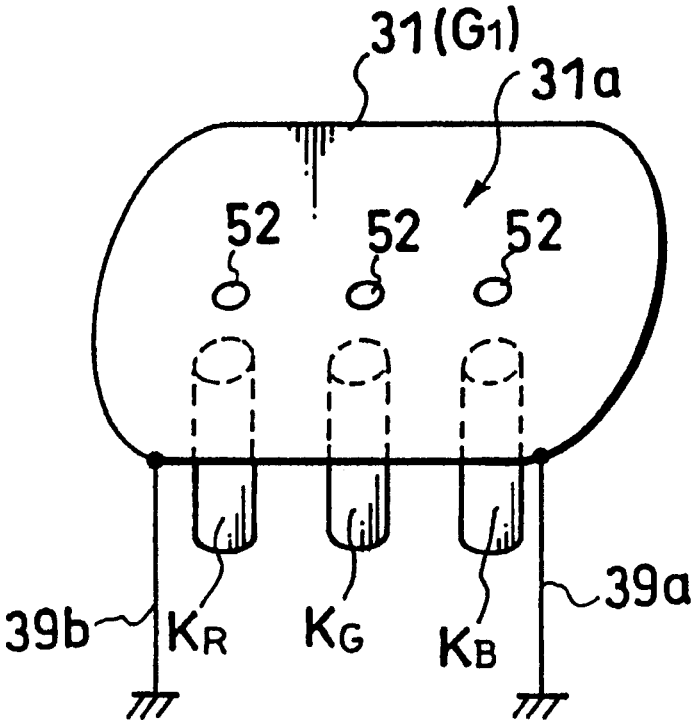
FIG. 11 is a schematic diagram showing the state in which a conduction lead connected to a first lead is provided at two places on one side.

In the embodiment shown in FIG. 11 (an arrangement in which only the cathode and the first electrode are illustrated as model examples), two first electrode leads 39*a*, 39*b* are led out from two places of the similar first electrode 31, i.e. two places of one side spaced apart from each other by a sufficiently long distance as seen from its electrode surface 31*a*.

According to this arrangement, the shield action can be given to the first electrode 31, and unwanted radiation can be improved.

If there are many more first electrode leads 39 so as to surround the cathodes $K_R$, $K_G$, $K_B$, e.g. if there are more than four first electrodes 39 along the diagonal lines, then the shield action of the first electrode 31 against the cathodes $K_R$, $K_G$, $K_B$ tends to become strong so that an effect for preventing the unwanted radiation is large.

However, the number of stem pins for supplying a voltage is limited. In most cases, there are generally provided 14 stem pins. Accordingly, as shown in FIGS. 7, 8, 9, if there are provided two or three first electrode leads 39, then unwanted radiation can be alleviated sufficiently. Thus, there should preferably be provided two to three stem pins in actual practice.

As is clear from the above-mentioned embodiments, when a plurality of first electrode leads 39 are led out from the first electrode 39, the respective first electrode leads may be spaced apart from each other by a distance enough to produce a shield action in the cathodes $K_R$, $K_G$, $K_B$.

Figure 12A:
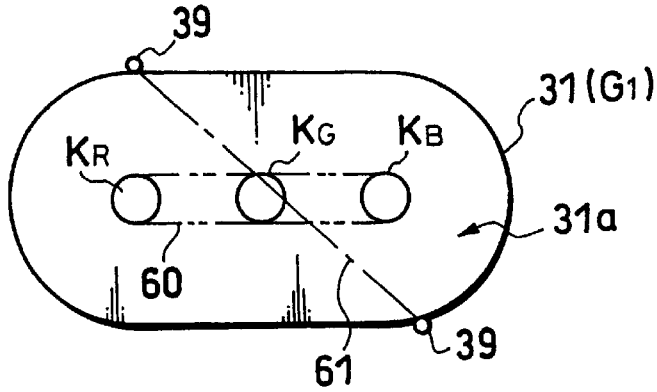
FIG. 12A is a schematic diagram showing the state in which a conduction lead connected to a first electrode is provided at two places overlapping with a cathode region.
Figure 12B:
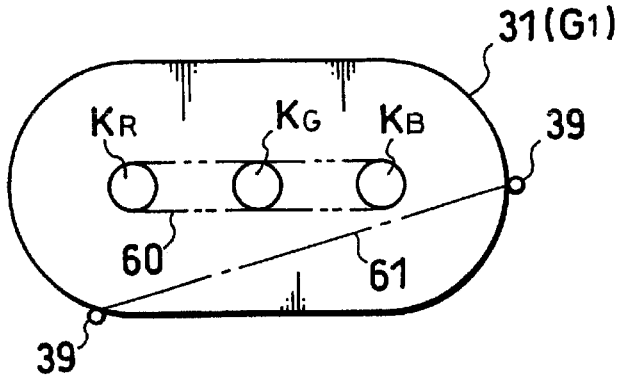
FIG. 12B is a schematic diagram showing the state in which a conduction lead connected to a first electrode is provided at two places passing the nearby portion of the cathode region.

More preferably, when there are provided more than two first electrode leads 39, the first electrode leads 39 should preferably be provided in a positional relationship such that a line 61 for connecting two points in which at least one set of opposing two leads exist overlaps with the region 60 in which the cathodes ($K_R$, $K_G$, $K_B$) are arranged in an inline fashion as shown in FIG. 12A or such line 61 passes the nearby portion of the region of the cathodes ($K_R$, $K_G$, $K_B$) as seen from an electrode surface 31*a* as shown in FIG. 12B.

Figure 12C:
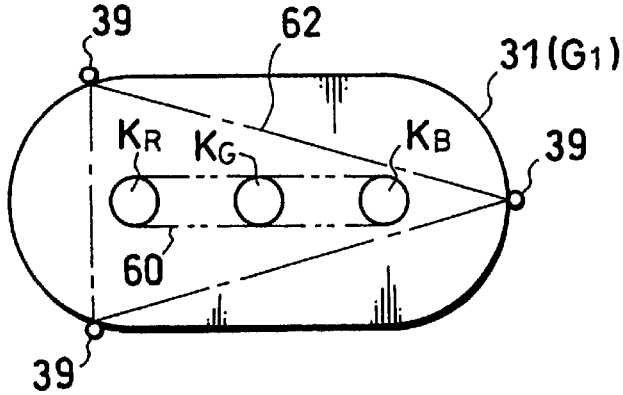
FIG. 12C is a schematic diagram showing the state in which a conduction lead connected to a first electrode is provided at three places surrounding the cathode region.
Figure 12D:
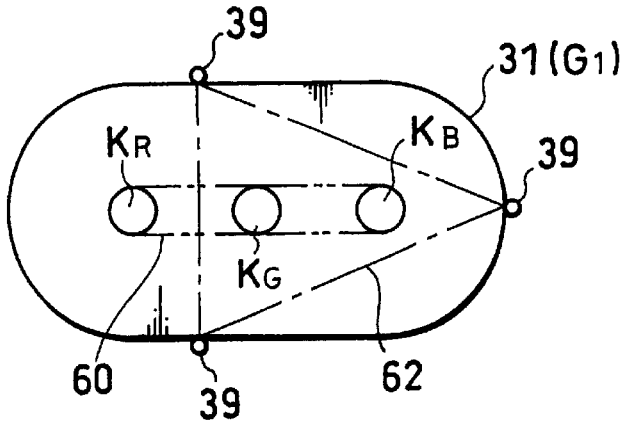
FIG. 12D is a schematic diagram showing the state in which a conduction lead connected to a first electrode is provided at three places overlapping with the cathode region.

Further, when there are provided more than three first electrode leads 39, the first electrode leads 39 should preferably be provided in a positional relationship such that the cathodes ($K_R$, $K_G$, $K_B$) exist in a polygon 62 formed by connecting respective points of the respective first electrode leads 39 as shown in FIG. 12C, for example, or the side of the polygon 62 overlaps with the region 60 of the cathodes ($K_R$, $K_G$, $K_B$) as shown in FIG. 12D.

On the other hand, there can be provided a plurality of conduction leads of the second electrode 32, i.e. second electrode leads 41 similarly to the above-mentioned first electrode 31.

Figure 13:
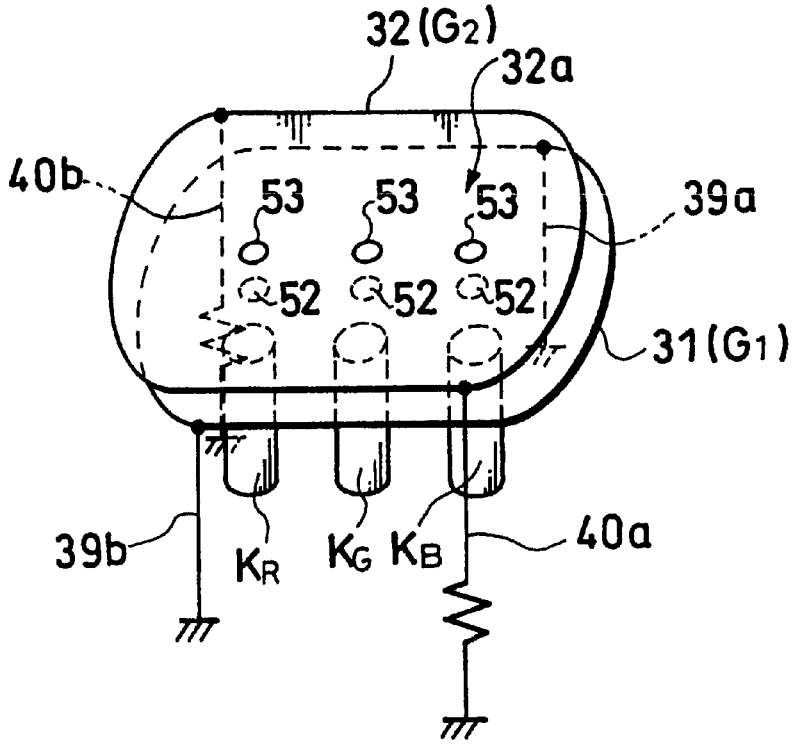
FIG. 13 is a schematic diagram showing a first electrode and a second electrode of an electron gun as model examples according to the present invention.

As shown in the embodiment shown in FIG. 13, two second electrode leads 40*a*, 40*b* are led out from two places of the oblong second electrode 32 of the plate-like shape, i.e. two opposing places across the cathodes $K_R$, $K_G$, $K_B$ of the inline arrangement as seen from its electrode surface 32*a*, in this embodiment, two places along the diagonal line directions. In FIG. 13, reference numerals 53 denote electron beam apertures defined in the second electrode 32 to pass electron beams. A voltage ranging from approximately 200V to 800V is applied to the two second electrode leads 40*a*, 40*b*.

The potential of 200V to 800V supplied to the second electrode 32 can be regarded as substantially a ground potential from a standpoint of anode potential (about 20 kV to 32 kV) or a focusing voltage (20% to 35% of anode potential). Accordingly, by providing two second electrode leads 40*a*, 40*b* on the two places of the second electrode 32 across the cathodes $K_R$, $K_G$, $K_B$, the second electrode 32 also can have the so-called shield action against the cathodes $K_R$, $K_G$, $K_B$, thereby making it possible to improve unwanted radiation.

In the embodiment shown in FIG. 13, two first electrode leads 39*a*, 39*b* and the second leads 40*a*, 40*b* are led out from both the first electrode 31 and the second electrode 32. In the case of the electron gun 29 with the arrangement shown in FIG. 13, it is possible to further alleviate the unwanted radiation as shown by a curve III in FIG. 15.

That is, a first peak corresponding to the range from 200 MHz to 400 Mhz shown by the curve II in FIG. 15 is brought about by the second electrode 32, and this is also true in the peaks following the second peak.

According to the embodiment shown in FIG. 13, there can be alleviated the unwanted radiation of the first peak between 200 MHz and 400 MHz.

Although not shown, the conduction lead 40 of the second electrode 32 can take the arrangement similar to that of the conduction lead 39 of the first electrode 31 described in FIGS. 7 to 12. Then, when both of the first electrode 31 and the second electrode 32 include a plurality of conduction leads 39, 40, there can be considered respective combinations using the above-mentioned examples. However, the positions at which the conduction leads 39, 40 of the first electrode 3 and the second electrode 32 are led out may be prevented from overlapping with each other. When there are provided the conduction leads 39, 40 of the same number, they should preferably be led out with a symmetrical relationship.

On the other hand, in the color cathode-ray tube 43 according to this embodiment shown in FIG. 6, as the electron gun 29, there is used an electron gun in which a plurality of conduction leads 39 of the first electrode 31, for example, are provided with the above-mentioned positional relationship.

Further, as the electron gun 29, there is used an electron gun in which there are provided a plurality of conduction leads 39 and 40 of the first electrode 31 and the second electrode 32, for example, with the aforementioned positional relationship.

According to the above-mentioned color cathode-ray tube 43, as shown by the curves II and III in FIG. 15, it is possible to alleviate unwanted radiation in the video band ranging from 300 MHz to 600 MHz as compared with the prior art. Accordingly, as shown in FIG. 6, there can be used such a very simple shield cover material for preventing the influence of the terrestrial magnetism as the shield cover material 50. Hence, a manufacturing cost can be reduced.

While the first electrode 31 is shaped as the plate, the present invention is not limited thereto, and may be applied to a first electrode of a cup-shape surrounding the cathode by deep-draw press.

Further, the present invention is not limited to the electron gun of the above-mentioned example, and it is needless to say that the present invention may be similarly applied to electron guns having other electrode structures.

Furthermore, while the present invention is applied to the color cathode-ray tube and its electron gun as described above, the present invention is not limited thereto, and may be similarly applied to other black and white cathode-ray tubes and electron guns.

Figure 14A:
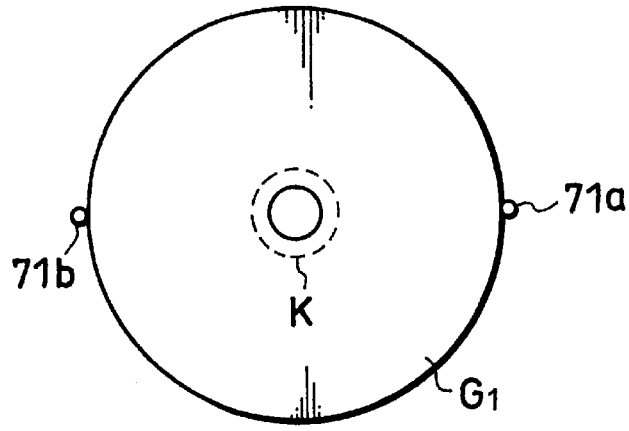
FIG. 14A is a schematic diagram showing the state in which a conduction lead connected to a black and white electron gun is provided at two places across the cathode.
Figure 14B:
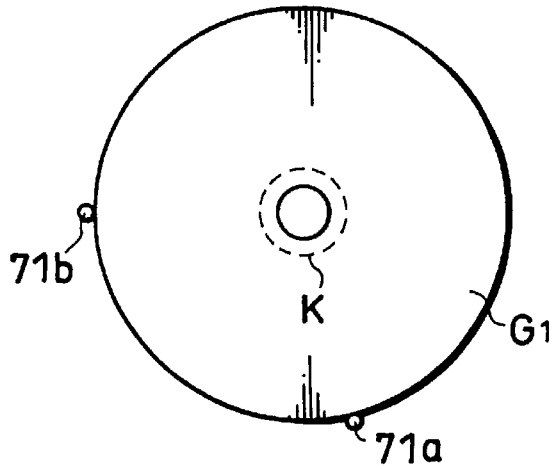
FIG. 14B is a schematic diagram showing the state in which a conduction lead connected to a black and white electron gun is provided at two places in which a shield action occurs.
Figure 14C:
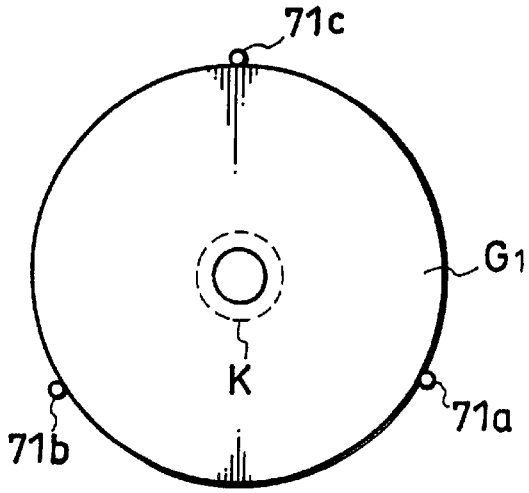
FIG. 14C is a schematic diagram showing the state in which a conduction lead connected to a black and white electron gun is provided at three places surrounding the cathode.

FIGS. 14A, 14B, 14C show examples of the first electrode $G_1$ required when the present invention is applied to a black and white electron gun. FIG. 14A shows the case in which two first electrode leads 71*a*, 71*b* are led out from the position opposing the first electrode $G_1$ across the cathode K.

FIG. 14B shows the case in which two first electrode leads 71*a*, 71*b* are led out from the first electrode $G_1$ by the distance long enough to produce the shield action against the cathode K.

FIG. 14C shows the case in which three first electrodes 71*a*, 71*b*, 71*c* are led out from the first electrode $G_1$ so as to surround the cathode K.

A plurality of conduction leads can be led out from the second electrode $G_2$ similarly to the first electrode $G_1$.

According to the cathode-ray tube electron gun according to the present invention, by increasing the number of the first electrode conduction leads from one to a plurality of conduction leads, it is possible to alleviate unwanted radiation caused by the antenna comprised of the cathode and the first electrode.

According to the cathode-ray tube electron gun according to the present invention, by increasing the number of the first electrode conduction leads from one to a plurality of conduction leads, it is possible to alleviate unwanted radiation caused similarly by the antenna comprised of the second electrode.

Further, according to the cathode-ray tube electron gun according to the present invention, by increasing the conduction leads of the first and second electrodes to a plurality of conduction leads, it is possible to further alleviate unwanted radiation caused by the antenna comprised of the cathode and the first and second electrodes.

Furthermore, according to the cathode-ray tube of the present invention, in a video band ranging from 300 MHz to 600 MHz, in particular, unwanted radiation can be alleviated as compared with the prior art. Therefore, the cathode-ray tube may include a simple shield cover material, and a cost thereof can be reduced.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A cathode-ray tube electron gun characterized in that a first electrode of unitized structure having a plurality of apertures includes a plurality of electrical conduction leads.

2. A cathode-ray tube electron gun characterized in that a first electrode of unitized structure having a plurality of apertures includes a plurality of electrical conduction leads and means for producing a shield action from unwanted radiation for cathode are arranged in said electrical conduction leads.

3. A cathode-ray tube electron gun comprising:

a cathode electrode and a first electrode, said cathode electrode generating an electron beam, said first electrode having at least one first electron beam aperture and a plurality of first electrical conduction leads, a first electron beam aperture of said at least one first electron beam aperture being a first opening, said first opening being within the surface of said first electrode, said first opening being structurally adapted to permit the passage of said electron beam through said first electrode, said plurality of first electrical conduction leads surrounding said cathode electrode to provide radiation shielding for said cathode electrode, wherein said cathode electrode is a plurality of electron beam electrodes and said electron beam is a plurality of electron beams, each electron beam electrode of said plurality of electron beam electrodes emitting a colored electron beam having a color different from another of said plurality of electron beam electrodes.

4. A cathode-ray tube electron gun according to claim 3, wherein each first electrical conduction lead of said plurality of first electrical conduction leads is in electrical contact with said first electrode.

5. A cathode-ray tube electron gun according to claim 3, wherein said plurality of first electrical conduction leads are two first electrical conduction leads.

6. A cathode-ray tube electron gun according to claim 3, wherein said plurality of first electrical conduction leads are more than two first electrical conduction leads.

7. A cathode-ray tube electron gun according to claim 3, further comprising:

a second electrode, said second electrode having at least one second electron beam aperture and at least one second electrical conduction lead, a second electron beam aperture of said at least one second electron beam aperture being a second opening, said second opening being within the surface of said second electrode, said second opening being structurally adapted to permit the passage of said electron beam through said second electrode.

8. A cathode-ray tube electron gun according to claim 3, wherein the electrical potential of a second electrical conduction lead of said at least one second electrical conduction lead is at said ground potential, said second electrical conduction lead of said at least one second electrical conduction lead being in electrical contact with said second electrode.

9. A cathode-ray tube electron gun according to claim 7, wherein said at least one second electrical conduction lead is at a potential in the range of 200 volts to 800 volts.

10. A cathode-ray tube electron gun according to claim 7, wherein said at least one second electrical conduction lead includes a plurality of second electrical conduction leads.

11. A cathode-ray tube electron gun according to claim 7, wherein said at least one second electrical conduction lead includes a plurality of second electrical conduction leads, said plurality of second electrical conduction leads providing further radiation shielding for said cathode electrode.

12. A cathode-ray tube electron gun comprising:

a cathode electrode and a first electrode, said cathode electrode generating an electron beam, said first electrode having at least one first electron beam aperture and a plurality of first electrical conduction leads, a first electron beam aperture of said at least one first electron beam aperture being a first opening, said first opening being within the surface of said first electrode, said first opening being structurally adapted to permit the passage of said electron beam through said first electrode, said plurality of first electrical conduction leads surrounding said cathode electrode to provide radiation shielding for said cathode electrode, wherein the electrical potential said plurality of first electrical conduction leads is at ground potential.

* * * * *